United States Patent [19]

Ikeda et al.

[11] 4,409,312

[45] Oct. 11, 1983

[54] DRY DEVELOPER FOR ELECTROSTATIC IMAGE WITH AL OR TI ALKOXIDE

[75] Inventors: Toshimitsu Ikeda, Himeji; Nobuyasu Honda, Tenri; Tetsuya Nakano, Osaka, all of Japan

[73] Assignee: Mita Industrial Co. Ltd., Osaka, Japan

[21] Appl. No.: 351,445

[22] Filed: Feb. 23, 1982

[30] Foreign Application Priority Data

Feb. 23, 1981 [JP] Japan ..... 56-24264

[51] Int. Cl.[3] ..... G03G 9/08; G03G 9/14

[52] U.S. Cl. ..... 430/110; 430/156.6; 430/109; 430/137

[58] Field of Search ..... 430/106.6, 109, 110, 430/137

[56] References Cited

U.S. PATENT DOCUMENTS

| | | | |
|---|---|---|---|
| 3,925,219 | 12/1975 | Strong | 430/109 |
| 3,983,045 | 9/1976 | Jugle et al. | 430/110 |
| 4,217,406 | 8/1980 | Tanaka et al. | 430/109 X |

FOREIGN PATENT DOCUMENTS

| | | | |
|---|---|---|---|
| 37297 | 12/1981 | European Pat. Off. | 430/106.6 |
| 43-21795 | 9/1968 | Japan | 430/109 |
| 48-43158 | 12/1973 | Japan | 430/110 |

*Primary Examiner*—Roland E. Martin, Jr.
*Attorney, Agent, or Firm*—Sherman & Shalloway

[57] ABSTRACT

Disclosed is a dry developer for an electrostatic image, which comprises molded particles of a dispersion of a binder medium, a wax and a pigment, wherein a combination or partial reaction product of (A) a copolymer of an olefin with a polar group-containing, ethylenically unsaturated monomer and (B) a metal alkoxide of aluminum or titanium is incorporated as a crosslinking agent into said molded particles.

In this dry developer, the mutual dispersibility of the respective developer components is highly improved, and the developer particles are uniform and homogeneous in the composition.

This dry developer for an electrostatic image is prepared by a process which comprises kneading a mixture of a binder resin, a wax and a pigment at a temperature higher than the softening points of the binder resin and wax and molding the kneaded composition into fine particles, wherein prior to, simultaneously with or after addition of the pigment, a combination or partial reaction product of (A) a copolymer of an olefin with a polar group-containing, ethylenically unsaturated monomer and (B) a metal alkoxide of aluminum or titanium is incorporated into the binder resin and wax and the composition is reacted in the molten state.

12 Claims, No Drawings

DRY DEVELOPER FOR ELECTROSTATIC IMAGE WITH AL OR TI ALKOXIDE

BACKGROUND OF THE INVENTION (1) Field of the Invention

The present invention relates to a dry developer for an electrostatic image and a process for the preparation thereof. More particularly, the present invention relates to a molded particulate developer consisting of a dispersion comprising a binder resin, a wax and a pigment, which is improved in the dispersibility of each component and the homogeneity of the composition.

(2) Description of the Prior Art

A product obtained by dispersing a pigment such as a coloring pigment, an extender pigment, a magnetic pigment or a conductive pigment in a binder medium which shows a fixing property under application of a heat or pressure and molding the dispersion into particles is widely used as a dry developer for an electrostatic image. As the fixing binder medium, resins are ordinarily used, but if resins alone are used, the fixing property is often insufficient, and therefore, waxes are widely used in combination with the resins. For example, in the case where developer particles are pressure-fixed, the resins are too hard and hence, it is necessary to use soft components such as waxes in combination with the resins. Furthermore, in the case where developer particles are fixed by contact with a heating roll, in order to prevent an offset phenomenon in which the developer particles migrate to the surface of the heating roll, it is desirable to use a wax as a parting agent in combination with a resin binder.

In a dispersion system comprising a binder resin, a wax and a pigment, it is very difficult to disperse the respective components uniformly and homogeneously. More specifically, waxes are oleophilic and non-polar, while most of pigments are hydrophilic and polar. Accordingly, if a pigment and a wax are dispersed in the molten state in a resin having a good dispersibility to pigments, it is found that the wax is heterogeneously dispersed in the form of considerably coarse particles, and if this molten dispersion is pulverized after cooling or under cooling to form particles, the composition greatly differs among respective particles and the resulting particulate developer is significantly insufficient in the adaptability to the developing and fixing operations and also in the quality of the formed image. For example, among these developer particles, those having a very high wax content cause reduction of the heat resistance of the developer and decrease of the flowability of the developer. Moreover, particles having an extremely low wax content cause an offset phenomenon on the heating roller. Moreover, for example, in case of a one-component type magnetic developer, since development is carried out based on the balance between the Coulomb force and the magnetic attractive force, developer particles having a low magnetic pigment content adhere to the background, resulting in increase of the fog density.

In addition to the foregoing defects, there arise still other problems. More specifically, when a heterogeneously dispersed molten mixture is pulverized after cooling or during cooling, heterogeneous portions of the texture are readily crumbled to form fine particles, which are removed at the classification step. Therefore, the yield of the particulate developer is reduced. Furthermore, in case of a two-component type developer, such fine particles cause contamination of a carrier.

SUMMARY OF THE INVENTION

We found that when a binder resin, a wax and a pigment are kneaded in the molten state, if a copolymer of an olefin with a polar group-containing, ethylenically unsaturated monomer and a metal alkoxide of aluminum or titanium are incorporated in the dispersion system of the above-mentioned three components, the mutual dispersibility among the binder resin, wax and pigment is prominently improved and the composition is uniform among respective particles, with the result that the above-mentioned defects can be eliminated effectively. We have now completed the present invention based on this finding.

It is therefore a primary object of the present invention to provide a dry developer for an electrostatic image, in which the mutual dispersibility among a binder resin, a wax and a pigment is prominently improved and developer particles are uniform in the composition, and a process for the preparation of this dry developer.

Another object of the present invention is to provide a dry developer for an electrostatic image, in which since respective components are homogeneously and finely dispersed in developer particles, the mechanical strength of the developer particles is highly improved and the developer particles are excellent in the resistance to dusting, the heat resistance and the blocking resistance, and a process for the preparation of this dry developer.

Still another object of the present invention is to provide a dry developer for an electrostatic image in which polar groups of the developer components are crosslinked or blocked with an aluminum or titanium alkoxide and hence, they are chemically stabilized, with the result that the ozone resistance and moisture resistance are highly improved, and a process for the preparation of this dry developer, A further object of the present invention is to provide a dry developer for an electrostatic image, in which the foregoing advantages can be attained without impairing a good pressure-fixing property or parting action (offset-preventing action) of the wax component.

A still further object of the present invention is to provide a process for the preparation of a dry developer for an electrostatic image, in which since the mutual dispersibility among a binder resin, a wax and a pigment is highly improved, the pulverizing property of the kneaded mixture of these components is very good and developer particles having a narrow particle size distribution can be prepared stably in a high yield.

In accordance with one fundamental aspect of the present invention, there is provided a dry developer for an electrostatic image, which comprises molded particles of a dispersion of a binder medium, a wax and a pigment, wherein a combination or partial reaction product of (A) a copolymer of an olefin with a polar group-containing, ethylenically unsaturated monomer and (B) a metal alkoxide of aluminum or titanium is incorporated as a crosslinking agent into said molded particles.

In accordance with another fundamental aspect of the present invention, there is provided a process for the preparation for a dry developer for an electrostatic image, which comprises kneading a mixture of a binder resin, a wax and a pigment at a temperature higher than the softening points of the binder resin and wax and molding the kneaded composition into fine particles, wherein prior to, simultaneously with or after addition of the pigment, a combination or partial reaction product of (A) a copolymer of an olefin with a polar group-containing, ethylenically unsaturated monomer and (B) a metal alkoxide of aluminum or titanium is incorporated into the binder resin and wax and the composition is reacted in the molten state.

DETAILED DESCRIPTION OF THE PREFERRED EMBODIMENTS

One of important characteristic features of the present invention is that as described hereinbefore, a combination or partial reaction product of (A) a copolymer of an olefin with a polar group-containing, ethylenically unsaturated monomer and (B) a metal alkoxide of aluminum or titanium is incorporated as a crosslinking agent. Since the copolymer (A) used in the present invention comprises non-polar or oleophilic ethylene recurring units and polar or hydrophilic monomer recurring units, the copolymer acts as a dispersing agent for homogeneously and finely dispersing the binder resin, wax and pigment mutually. Furthermore, the combination of the copolymer (A) and metal alkoxide (B) crosslinks the binder resin and wax through this combination and exerts a function of stabilizing the fine and homogeneous dispersion texture. More specifically, the polar group of the copolymer (A) reacts with the polar group contained in the binder resin or wax through the polyfunctional metal alkoxide, whereby a crosslinked structure is introduced. Formation of this crosslinked structure is confirmed from the fact that when the copolymer (A) and metal alkoxide (B) are incorporated in the dispersion system of the binder resin, wax and pigment and melt-kneading of the composition is continued, the dynamic viscosity of the composition is increased with the lapse of time.

From the foregoing description, it will readily be understood that according to the present invention, the respective components of the molten mixture for formation of a developer can be mutually dispersed finely and homogeneously and if this molten mixture is pulverized, there can be obtained a dry developer in which the particle size is uniform and the respective particles are homogeneous in the composition. Furthermore, the developer particles according to the present invention have the above-mentioned uniform and fine dispersion texture and this dispersion texture is stabilized by the crosslinkage. Accordingly, the developer particles have a high mechanical strength and are excellent in the resistance to dusting, the heat resistance and the blocking resistance. Moreover, since the polar groups of the developer components are crosslinked or blocked by the above-mentioned crosslinking reaction, the developer of the present invention is chemically stabilized and excellent in the ozone resistance and moisture resistance and has a durability enough to resist a long-time operation in a copying machine or the like. Still another unexpected advantage attained by the present invention is that the foregoing various effects can be attained without substantial reduction of the pressure-fixing property and offset-preventing action of the wax.

In the present invention, as the copolymer of the olefin with the polar group-containing, ethylenically unsaturated monomer, there are used copolymers formed by introducing a polar group-containing, ethylenically unsaturated monomer into an olefin such as ethylene, propylene or butene-1 by such means as random polymerization, block copolymerization or graft polymerization. By the term "polar group-containing, ethylenically unsaturated monomer" is meant a monomer containing at least one of carboxyl, acid anhydride, ester, amide, hydroxyl, epoxy and alkoxy groups. Suitable examples are described below, though monomers applicable in the present invention are not limited to those exemplified below. Ethylenically unsaturated carboxylic acids and anhydrides thereof:

Acrylic acid, methacrylic acid, crotonic acid, maleic anhydride, fumaric acid, itaconic anhydride, citraconic acid, aconitic acid and tetrahydrophthalic anhydride. Vinyl esters and hydrolysis products thereof:

Vinyl formate, acetic acid esters, vinyl propionate and vinyl alcohol.

Acrylic esters and amides:

Ethyl acrylate, methyl methacrylate, butyl acrylate, amyl acrylate, 2-ethylhexyl acrylate, 2-ethylhexyl methacrylate, 2-hydroxyethyl acrylate, 3-hydroxypropyl acrylate, acrylamide, methacrylamide and 2-ethoxyethyl methacrylate.

Epoxy group-containing monomers:

Glycidyl acrylate and glycidyl methacrylate.

Copolymers suitable for attaining the objects of the present invention are copolymers of ethylene with at least one member selected from vinyl esters, vinyl alcohol, ethylenically unsaturated carboxylic acids and anhydrides thereof. For example, an ethylene-vinyl acetate copolymer, a partially or completely saponified ethylene-vinyl acetate copolymer, an ethylene-acrylic acid copolymer, an ion crosslinked ethylene copolymer (ionomer), an acrylic acid-grafted polyethylene and a maleic anhydride-grafted polyethylene are advantageously used for attaining the objects of the present invention.

In the copolymer (A) that is used in the present invention, in order to improve the dispersibility of the developer components, it is preferred that the molar ratio of the olefin to the polar group-containing, ethylenically unsaturated monomer be in the range of from 99/1 to 60/40, especially from 97/3 to 70/30. Moreover, it is preferred that the softening point of the copolymer (A) be from 80° to 180° C.

The metal alkoxide that is used in the present invention is a polyfunctional metal alkoxide containing aluminum or titanium as the metal component. There are preferably used alkoxides represented by the following general formula:

$$M(OR)_mX_{n-m}$$

wherein M stands for an aluminum or titanium atom, R stands for an alkyl group having up to 10 carbon atoms, X stands for a ligand derived from a $\beta$-diketone or $\beta$-keto-acid ester or an acyloxy group, m is a number of from 2 to 4, and n represents the atomic valency of the metal M, such as titanium tetra-isopropoxide, titanium n-butoxide, tetrakis(2-ethylhexoxy)titanium, aluminum tri-isopropoxide, mono-n-butoxy-di-isopropoxy aluminum, di-isopropoxy-bis-(acetylacetonato)titanium, tri-n-butoxy titanium monostearate and di-isopropoxy aluminum ethylacetoacetate. These metal alkoxides may be used in the form of an oligomer such as a dimer, or they may be used in the form of a polymer, for example, a polymer represented by the following formula:

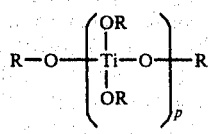

wherein p is a number of from 2 to 10.

In the present invention, it is preferred that the copolymer (A) be used in an amount of 0.5 to 30 parts by weight, especially 1 to 25 parts by weight, and the metal alkoxide (B) be used in an amount of 0.1 to 10 parts by weight, especially 0.2 to 5 parts by weight, per 100 parts by weight of the sum of the binder resin and wax. If the amount of the copolymer (A) or metal alkoxide (B) is too small and is below the above-mentioned range, it is difficult to sufficiently improve the mutual dispersibility among the binder resin, wax and pigment, and if the amount of the copolymer (A) or metal alkoxide (B) is too large and exceeds the above-mentioned range, the crosslinked structure is excessively introduced and hence, the fixing property is apt to decrease.

Any of natural, semi-synthetic and synthetic resins showing an adhesiveness under application of heat or pressure can be used as the binder resin in the present invention. These resin binders may be thermoplastic resins, or uncured thermosetting resins or their precondensates. Valuable natural resins include, for example, balsam resin, rosin, shellac and copal, and these natural resins may be modified with at least one member selected from vinyl resins, acrylic resins, alkyd resins, phenolic resins, epoxy resins and oleoresins, which are described hereinafter. As the synthetic resin, there can be used vinyl resins such as a vinyl chloride resin, a vinylidene chloride resin, a vinyl acetate resin, a vinyl acetal resin, e.g., polyvinyl butyral, and a vinyl ether polymer, acrylic resins such as polyacrylic acid ester, a polymethacrylic acid ester and an acrylic acid copolymer, styrene type resins such as polystyrene, a hydrogenated styrene resin, polyvinyl toluene and a styrene copolymer, polyamide resins such as nylon-12, nylon-6 and a polymerized fatty acid-modified polyamide, polyesters such as polyethylene terephthalate/isophthalate and polytetramethylene terephthalate/isophthalate, alkyd resins such as a phthalic acid resin and a maleic acid resin, phenol-formaldehyde resins, ketone resins, coumarone-indene resins, terpene resins, amino resins such as a urea-formaldehyde resin and a melamine-formaldehyde resin, and epoxy resins. These synthetic resins may be used in the form of a mixture of two or more of them. For example, a mixture of a phenolic resin and an epoxy resin and a mixture of an amino resin and an epoxy resin may be used.

The binder resin especially suitable for attaining the objects of the present invention is a copolymer of a vinyl aromatic monomer, especially a monomer represented by the following formula:

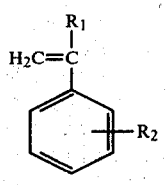

wherein $R_1$ stands for a hydrogen atom or a lower alkyl group, and $R_2$ stands for a hydrogen atom or an alkyl group, such as styrene, α-methylstyrene or vinyltoluene, with an acrylic monomer such as acrylic acid, methacrylic acid or an ester or amide thereof.

In the present invention, as the wax, there are used naturally produced waxes such as vegetable waxes, animal waxes, solid fats and mineral waxes, and higher fatty acids, their derivatives and other synthetic waxes which have a melting point higher than 60° C., especially a softening point of 65° to 160° C. Waxes having softening points lower than 60° C. or so-called liquid waxes tend to agglomerate developer particles and therefore, they are not suitable for attaining the objects of the present invention.

Waxes that can suitably be used in the present invention are described below, though waxes that can be used in the present invention are not limited to those exemplified below.

Namely, there can be mentioned waxes in a narrow sense such as carnauba wax, cotton wax, candelilla wax, sugar cane wax, bees wax and wool wax, mineral waxes such as montan wax, paraffin wax and microcrystalline wax, solid higher fatty acids having 16 to 22 carbon atoms such as palmitic acid, stearic acid, hydroxystearic acid and behenic acid, amides of higher fatty acids having 16 to 22 carbon atoms (the word "higher" is used hereinafter to indicate "having 16 to 22 carbon atoms") such as oleic acid amide, stearic acid amide, palmitic acid amide, N-hydroxyethyl-hydroxystearoamide, N,N'-ethylene-bis-stearoamide, N,N'-ethylene-bis-ricinolamide and N,N'-ethylene-bis-hydroxystearylamide, alkali metal, alkaline earth metal, zinc and aluminum salts of higher fatty acids such as calcium stearate, aluminum stearate, magnesium stearate and calcium palmitate, higher fatty acid hydrazides such as palmitic hydrazide and stearic hydrazide, high fatty acid p-hydroxyanilides such as myristic p-hydroxyanilide and stearic p-hydroxyanilide, β-diethylaminoethyl ester hydrochlorides of higher fatty acids such as β-diethylaminoethyl laurate hydrochloride and β-diethylaminoethyl stearate hydrochloride, high fatty acid amide-formaldehyde condensates such as stearic acid amide-formaldehyde condensate and palmitic acid amide-formaldehyde condensate, amino group-containing dyes and dye bases and their salt-forming reaction products with at least 4 mols of a higher fatty acid, such as salt-forming reaction products of amino group-containing dyes and dye bases with stearic acid, palmitic acid and myristic acid, hardened oils such as hardened castor oil and hardened beef-tallow oil, and polyethylene wax, polypropylene wax and oxidized polyethylene.

In the present invention, the binder resin and wax can be used in combination in a broad range of the weight ratio of from 99/1 to 1/99. For example, in case of a pressure-fixing developer, the wax is used in a relatively large amount and the weight ratio of the binder resin to the wax is in the range of from 85/15 to 1/99, and in case of a heat-fixing developer, the wax is used in a relatively small amount and the weight ratio of the binder resin to the wax is in the range of from 99/1 to 80/20.

In the present invention, as the pigment, there may be used at least one member selected from coloring pigments, extender pigments, magnetic pigments and conductive pigments. Of course, a pigment having two or more of the foregoing functions may be used. For example, carbon black which is either a black color pigment or a conductive pigment and tri-iron tetroxide which is either a magnetic pigment or a black color pigment generally called "iron black" may be used in the present invention.

Preferred examples of coloring pigments are as follows.

Black pigments:

Carbon black, acetylene black, lamp black and aniline black.

Yellow pigments:

Chrome yellow, zinc yellow, cadmium yellow, yellow iron oxide, Mineral Fast Yellow, Nickel Titanium Yellow, Naples Yellow, Naphthol Yellow S, Hansa Yellow G, Hansa Yellow 10G, Benzidine Yellow G, Benzidine Yellow GR, Quinoline Yellow Lake, Permanent Yellow NCG and Tartrazine Yellow Lake.

Orange Pigments:

Chrome orange, molybdenum orange, Permanent Orange GTR, Pyrazolone Orange, Vulcan Orange, Indanthrene Brilliant Orange RK, Benzidine Orange G, Indanthrene Brilliant Orange GK.

Red Pigments:

Red iron oxide, cadmium red, red lead, mercury sulfide, cadmium, Permanent Red 4R, Lithol Red, Pyrazolone Red, Watchung Red Calcium salt, Lake Red D, Brilliant Carmine 6B, Eosine Lake, Rhodamine Lake B, Alizarine Lake and Brilliant Carmine 3B.

Violet pigments:

Manganese violet, Fast Violet B and Methyl Violet Lake.

Blue pigments:

Prussian blue, cobalt blue, Alkali Blue Lake, Victoria Blue Lake, Phthaloycyanine Blue, metal-free Phthalocyanine Blue, partially chlorinated Phthalocyanine Blue, Fast Sky Blue and Indanthrene Blue BC.

Green pigments:

Chrome Green, Chromium oxide, Pigment Green B, Malachite Green Lake and Fanal Yellow Green.

White pigments:

Zinc flower, titanium oxide, antimony white and zinc sulfide.

Extender pigments:

Baryta powder, barium carbonate, clay, silica, white carbon, talc and alumina white.

As the magnetic pigment, there are known tri-iron tetroxide ($Fe_3O_4$), di-iron trioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodium iron oxide ($NdFeO_3$), barium iron oxide ($BaFe_{12}O_{19}$), maganesium iron oxide ($MgFe_2O_4$), manganese iron oxide ($MnFe_2O_4$), lanthanum iron oxide ($LaFeO_3$), iron powder (Fe), cobalt powder (Co) and nickel powder (Ni). Fine powders of these known magnetic materials can optionally be used as the magnetic pigment. Tri-iron tetroxide is a magnetic pigment especially suitable for attaining the objects of the present invention.

As the conductive pigment, there can be used not only the above-mentioned carbon black but also a non-conductive fine powder which has been subjected to a conductive treatment or a metal powder.

The amount of the pigment is changed in a wide range according to the intended use of the developer. For example, the pigment is ordinarily used in an amount of 1 to 300 parts by weight per 100 parts by weight of the sum of the binder resin and wax. In case of a two-component type developer which is used in combination with a magnetic carrier, it is preferred that a coloring pigment be used in an amount of 1 to 15 parts by weight, especially 2 to 10 parts by weight, per 100 parts by weight of the sum of the binder resin and wax, and in case of a one-component type developer, it is preferred that a magnetic pigment be used in an amount of 50 to 300 parts by weight, especially 100 to 250 parts by weight, per 100 parts by weight of the sum of the binder resin and wax, optionally with a coloring pigment or a conductive pigment if necessary.

Known additives may be incorporated in the developer of the present invention according to known recipes. For example, in case of a two-component type developer, a known charge controlling agent such as an oil-soluble dye, e.g., Nigrosine Base (CI 5045), Oil Black (CI 26150) or Spiron Black, or a metal complex dye, or a metal salt of naphthenic acid, a metal soap of a fatty acid or a resin acid soap may be incorporated in an amount of 0.1 to 5 parts by weight per 100 parts by weight of the resin binder and wax.

For preparation of the developer of the present invention, a mixture of the binder resin, wax and pigment is kneaded at a temperature higher than the softening points of the binder resin and wax according to known procedures. At this kneading step, prior to, simultaneously with or after addition of the pigment, a combination of partial reaction product of (A) a copolymer of an olefin with a polar group-containing, ethylenically unsaturated monomer and (B) a metal alkoxide of aluminum or titanium is incorporated and the composition is reacted in the molten state. By incorporating the copolymer (A) and metal alkoxide (B), the mutual dispersion state of the binder resin, wax and pigment is highly improved and a very homogeneous dispersion can be obtained, and crosslinking is advanced in this homogeneous dispersion. The melt kneading can be accomplished by a kneading apparatus such as a heating roll, a mixer or a kneader. At this kneading step, there may be adopted a method in which all the developer components are dry-blended and kneading is then carried out, or a method in which after kneading of the components except the pigment, the copolymer (A) and metal alkoxide (B) are incorporated simultaneously with or independently from the pigment.

Instead of the method in which the developer components are melt-kneaded, there may be adopted a method in which the respective developer components are stirred in a high speed stirrer such as a super-mixer under such conditions that a frictional heat is produced, whereby developer particles in which the respective components are integrated by fusion bonding can be obtained.

The reaction of the copolymer (A) and metal alkoxide (B) with the binder resin and wax is carried out at a temperature higher than the softening points of the binder resin and wax. It is preferred that this reaction be carried out at a temperature of 90° to 150° C. for 5 to 60 minutes. Stopping of the reaction can easily be accomplished by hydrolyzing the alkoxy group of the metal alkoxide with water to a hydroxyl group. Since completion of the reaction can easily be confirmed by abrupt increase of the viscosity, water is added to the reaction mixture when abrupt increase of the viscosity is observed. A partial reaction product obtained by preliminarily heating the copolymer (A) and metal alkoxide (B) in a short time may be added to the kneaded composition.

According to the present invention, the so-obtained kneaded composition is cooled to room temperature or a lower temperature and pulverized by a fine pulverizer such as a jet mill, a roll mill or a pin mill and is then classified according to need, whereby the developer of the present invention can be obtained. Instead of the method of pulverizing the cooled product, there may be adopted a method in which the molten mixture of the developer components is directly formed into developer particles by spray granulation, centrifugal granulation or the like.

It is preferred that the particle size of the developer particles be controlled to 5 to 50 microns. If desired, a small amount of a flowability-improving agent such as finely divided dry-method silica may be added to the developer particles.

The present invention will now be described in detail with reference to the following Examples that by no means limit the scope of the present invention.

EXAMPLE 1

| | |
|---|---|
| Tri-iron tetroxide (Iron Black BM611 supplied by Toyo Shikiso Kogyo Kabushiki Kaisha) | 55 parts by weight |
| Styrene-acrylic copolymer (Pliolite ACL supplied by Goodyear Tire and Rubber Co.) | 35 parts by weight |
| Ethylene-vinyl acetate copolymer (Evaflex 420 supplied by Mitsui Polychemical Kabushiki Kaisha) | 2 parts by weight |
| Polypropylene (Viscol 550P supplied by Sanyo Kasei Kogyo Kabushiki Kaisha) | 8 parts by weight |
| Titanium tetraisopropoxide (TPT A-1 supplied by Nippon Soda Kabushiki Kaisha) | 0.5 part by weight |

The foregoing components, exclusive of titanium tetraisopropoxide, were kneaded at 130° C. for 30 minutes by a heating kneader (Model D3-7.5 supplied by Moriyama Seisakusho Kabushiki Kaisha), and titanium tetraisopropoxide was added to the kneaded composition and the composition was further kneaded for 40 minutes. The kneaded composition was cooled, and then, it was roughly pulverized by a feather mill and finely pulverized by a jet mill pulverizer. Magnetic particles having a size of 10 to 15μ were collected by an air classifying machine. When the magnetic particles were subjected to the heat resistance test, it was found that they showed a good heat resistance to temperatures of up to 55° C. The magnetic particles were blended with 0.5% by weight of silica (Aerosil R972) by a mixer to form toner particles. A dry type electronic copying machine provided with a selenium-type photosensitive drum and a magnetic brush-type developing device (Electonic Copystar Model MC-20 supplied by Mita Industrial Co., Ltd.) was modified so that the fixing zone comprised a heating roll fixing device maintained at 170° to 185° C., and in this copying machine, the so-obtained toner was subjected to the printing test for obtaining 10,000 prints. Each of the obtained 10,000 prints had a good image density without fogging.

Comparative Example 1

| | |
|---|---|
| Tri-iron tetroxide (Iron Black BM611) | 55 parts by weight |
| Styrene-acrylic copolymer (Pliolite ACL) | 35 parts by weight |
| Ethylene-vinyl acetate copolymer (Evaflex 420) | 2 parts by weight |
| Polypropylene (Viscol 550P) | 8 parts by weight |

Comparative Example 2

| | |
|---|---|
| Tri-iron tetroxide (Iron Black BM611) | 55 parts by weight |
| Styrene-acrylic copolymer (Pliolite ACL) | 35 parts by weight |
| Polypropylene (Viscol 550P) | 8 parts by weight |

The above mixtures of Comparative Examples 1 and 2 were independently treated in the same manner as described in Example 1 to obtain magnetic particles having a particle size of 10 to 15μ. These magnetic particles were blended with 0.5% by weight of silica (Aerosil R972) by a mixer to form toner particles. The so-obtained toner particles were subjected to the heat resistance test. It was found that each of the products obtained in Comparative Examples 1 and 2 was inferior to the product of Example 1 in the heat resistance. More specifically, the product of Comparative Example 1 could resist temperatures of up to 50° C. and the product of Comparative Example 2 could resist temperatures of up to 45° C. When the toner particles were observed by a microscope at 600 magnifications, it was found that all the particles obtained in Example 1 were uniformly opaque whereas about 20% of the particles obtained in Comparative Example 1 were transparent and about 50% of the particles obtained in Comparative Example 2 were transparent, and that in the toner particles obtained in Comparative Examples 1 and 2, the dispersibility of tri-iron tetroxide was bad.

EXAMPLE 2

Magnetic particles and toner particles were obtained in the same manner as described in Example 1 except that titanium tetrabutoxide was used instead of titanium tetraisopropoxide used in Example 1. When the particles were observed by a microscope, it was found that all the particles were uniformly opaque.

EXAMPLE 3

Magnetic particles and toner particles were prepared in the same manner as described in Example 1 except that 1 part by weight of titanium monostearate tributoxide was used instead of titanium tetraisopropoxide used in Example 1. When the particles were observed by a microscope, it was found that all the particles were uniformly opaque.

EXAMPLE 4

| | |
|---|---|
| Tri-iron tetroxide (Iron Black BM611) | 60 parts by weight |
| Polyamide (Versamid 940 supplied by Daiichi Kogyo Seiyaku Kabushiki Kaisha) | 11 parts by weight |
| Polyethylene (Hi-Wax 200P supplied by Mitsui Sekiyu Kagaku Kogyo Kabushiki Kaisha) | 20 parts by weight |
| Ethylene-vinyl acetate copolymer (ACP-400 supplied by Allied Chemical Corporation) | 7 parts by weight |
| Ethylene-vinyl acetate copolymer (Evaflex 460 supplied by Mitsui Polychemical Kabushiki Kaisha) | 2 parts by weight |
| Titanium tetraisopropoxide (TPT A-1) | 1 part by weight |

In the same manner as described in Example 1, pressure-fixing magnetic particles having a particle size of 10 to 15μ were prepared from the above mixture and the magnetic particles were blended with 1% by weight of silica (Aerosil R972) by a mixer to obtain pressure-fixing magnetic toner particles. By microscopic observation, it was confirmed that all the particles were uniformly opaque.

EXAMPLE 5

| | |
|---|---|
| Tri-iron tetroxide (Iron Black B6 supplied by Toyo Shikiso Kogyo Kabushiki Kaisha) | 65 parts by weight |
| Polyamide (Versamid 940) | 9 parts by weight |
| Polyethylene (Hi-Wax 200P) | 18 parts by weight |
| Ethylene-acrylic acid copolymer (AC-540 supplied by Allied Chemical Corporation) | 8 parts by weight |
| Carbon black (Special Black IV supplied by Degusa Co.) | 5 parts by weight |
| Aluminum butoxide (ASBD supplied by Kawaken Fine Chemical Kabushiki Kaisha) | 1.5 parts by weight |

EXAMPLE 6

| | |
|---|---|
| Tri-iron tetroxide (Iron Black B6) | 65 parts by weight |
| Styrene-acrylic copolymer (Himer SBM 73 supplied by Sanyo Kasei Kogyo Kabushiki Kaisha) | 24 parts by weight |
| Polypropylene (Viscol 550P) | 6 parts by weight |
| Ethylene-vinyl acetate copolymer (Evaflex 420) | 5 parts by weight |
| Carbon black (Special Black IV) | 5 parts by weight |
| Aluminum isopropoxide (AIPD supplied by Kawaken Fine Chemical Kabushiki Kaisha) | 1 part by weight |

Kneading, pulverization and classification were carried out in the same manner as described in Example 1 to obtain magnetic particles having a particle size of 10 to 15μ from the above-mentioned mixtures of Examples 5 and 6, respectively. By microscopic observation, it was confirmed that in each of the products obtained in Examples 5 and 6, all the particles were uniformly opaque. The magnetic particles of Example 5 were blended with 1% by weight of carbon black by a mixer to obtain a pressure-fixing conductive magnetic toner having an electric resistance of $10^7$ Ω-cm, and the magnetic particles of Example 6 were blended with 0.6% by weight of carbon black by a mixer to obtain a heat-fixing conductive magnetic toner having an electric resistance of $10^9$ Ω-cm.

The copying test was carried out by using the magnetic toners obtained in Examples 1 through 6 and Comparative Examples 1 and 2. The obtained results are shown in Table 1.

In the copying test, a dry-type electronic copying machine (Electronic Copystar Model MC-20 supplied by Mita Industrial Co., Ltd.) was used as the copying machine, and in case of a heat-fixing toner, a heating roll fixing device was attached to the fixing zone. When 4000 prints were obtained in case of the toner of Comparative Example 1 and when 2000 prints were obtained in Comparative Example 2, blocking was caused and the image density was drastically reduced.

In Examples 1 through 4 and Comparative Examples 1 and 2, plain papers for PPC were used as copy sheets and in Examples 5 and 6, insulated papers were used as copy sheets.

The image density and fog density were measured by Sakura Densitometer Model PDA65 (supplied by Konishiroku Shashin Kogyo Kabushiki Kaisha). The heat resistance was determined according to the following procedures.

A glass cylinder having an inner diameter of 2.5 cm was charged with 10 g of the sample toner, and a cylindrical weight having an outer diameter of 2.4 cm and a weight of 100 g was placed on the sample and the sample was placed in this state in an oven maintained at a predetermined temperature for 30 minutes. The sample was taken out and after 5 minutes, the glass cylinder was quietly lifted up. When blocking was not caused in the sample, the sample was let to fall down because of the presence of the weight, but when blocking was caused in the sample, the toner did not fall down. The heat resistance was expressed by the highest temperature at which the sample was let to fall down when the glass cylinder was quietly lifted up. Such highest temperatures are shown in Table 1.

TABLE 1

| | Image Density on Production of 10000 Prints and Heat Resistance | | | | | | | | |
|---|---|---|---|---|---|---|---|---|---|
| | Image Density | | | | Fog Density | | | | Heat Resistance (°C.) |
| Toner | first print | 2000th print | 5000th print | 10000th print | first print | 2000th print | 5000th print | 10000th print | |
| Example 1 | 1.45 | 1.46 | 1.45 | 1.43 | 0.01 | 0.01 | 0.01 | 0.01 | 55 |
| Comparative Example 1 | 1.28 | 1.20 | — | — | 0.01 | 0.03 | — | — | 50 |
| Comparative Example 2 | 1.08 | 0.87 | — | — | 0.02 | 0.05 | — | — | 45 |
| Example 2 | 1.47 | 1.45 | 1.46 | 1.45 | 0.01 | 0.01 | 0.01 | 0.01 | 55 |
| Example 3 | 1.50 | 1.48 | 1.49 | 1.48 | 0.01 | 0.01 | 0.01 | 0.01 | 60 |
| Example 4 | 1.58 | 1.60 | 1.59 | 1.61 | 0.01 | 0.01 | 0.01 | 0.01 | 55 |
| Example 5 | 1.32 | 1.30 | 1.30 | 1.30 | 0.02 | 0.02 | 0.02 | 0.02 | 60 |
| Example 6 | 1.25 | 1.20 | 1.20 | 1.21 | 0.01 | 0.01 | 0.01 | 0.01 | 60 |

EXAMPLE 7

| | |
|---|---|
| Styrene-acrylic copolymer (Pliolite ACL) | 87 parts by weight |
| Polypropylene (Viscol 550P) | 4 parts by weight |
| Ethylene-vinyl acetate copolymer (Evaflex 460) | 9 parts by weight |
| Carbon black (Special Black IV) | 8 parts by weight |
| Dye (Bontoron S-31 supplied by Orient Kagaku Kogyo Kabushiki Kaisha) | 2 parts by weight |
| Titanium tetraisopropoxide (TPT A-1) | 2 parts by weight |

In the same manner as described in Example 1, kneading, pulverization and classification were carried out to obtain toner particles having a size of 10 to 15μ. By microscopic observation, it was confirmed that all the particles were uniformly opaque. Then, 100 parts by weight of the so-obtained toner was mixed with 900 parts by weight of iron powder as a carrier to obtain a developer.

Comparative Example 3

| | |
|---|---|
| Styrene-acrylic copolymer (Pliolite ACL) | 87 parts by weight |
| Polypropylene (Viscol 550P) | 4 parts by weight |
| Ethylene-vinyl acetate copolymer (Evaflex 460) | 9 parts by weight |
| Carbon black (Special Black IV) | 8 parts by weight |
| Dye (Bontoron S-31) | 2 parts by weight |

Comparative Example 4

| | |
|---|---|
| Styrene-acrylic copolymer (Pliolite ACL) | 96 parts by weight |
| Polypropylene (Viscol 550P) | 4 parts by weight |
| Carbon black (Special Black IV) | 8 parts by weight |
| Dye (Bontoron S-31) | 2 parts by weight |

In the same manner as described in Example 7, kneading, pulverization and classification were carried out to obtain toner particles having a particle size of 10 to 15μ. By microscopic observation, it was found that 40% of particles of Comparative Example 3 were transparent or semi-transparent and 50% of particles of Comparative Example 4 were transparent or semi-transparent, and that the particles of the toners of Comparative Examples 3 and 4 were inferior to the particles of the toner of Example 7 in the homogeneity and uniformity.

Developers were prepared by mixing 100 parts by weight of the so-obtained toner with 900 parts by weight of iron powder as a carrier.

The copying test for obtaining 100,000 prints was carried out in a dry-type electronic copying machine (Electronic Copystar Model DC161 supplied by Mita Industrial Co., Ltd.) by using the toners obtained in Example 7 and Comparative Examples 3 and 4 independently. The obtained results are shown in Table 2.

The quantity of the spent toner was determined according to the following procedures.

After 100,000 prints had been obtained, the toner contained in the developer was removed by water washing, and the toner adhering to the carrier particles was dissolved away by an organic solvent and the quantity of the dissolved toner was measured as the quantity of the spent toner.

TABLE 2

Results of Copying Test for Obtaining 100,000 Prints

| Toner | Image Density first print | Image Density 10000th print | Image Density 50000th print | Image Density 100000th print | Fog Density first print | Fog Density 10000th print | Fog Density 50000th print | Fog Density 100000th print | Quantity (% by weight) of Spent Toner | Heat Resistance (°C.) |
|---|---|---|---|---|---|---|---|---|---|---|
| Example 7 | 1.43 | 1.45 | 1.42 | 1.40 | 0.01 | 0.01 | 0.01 | 0.01 | 0.5 | 60 |
| Comparative Example 3 | 1.30 | 1.15 | 1.07 | 0.92 | 0.01 | 0.03 | 0.08 | 0.09 | 2.3 | 50 |
| Comparative Example 4 | 1.25 | 1.00 | 0.83 | 0.75 | 0.02 | 0.05 | 0.09 | 0.12 | 2.6 | 45 |

What is claimed is:

1. A dry developer for an electrostatic image, which comprises molded particles of a dispersion of a binder medium, a wax and a pigment, wherein a combination or partial reaction product of (A) a copolymer of an olefin with a polar group-containing, ethylenically unsaturated monomer and (B) a metal alkoxide of aluminum or titanium is incorporated as a crosslinking agent into said molded particles and wherein 1 to 25 parts by weight of the copolymer (A) and 0.2 to 5 parts by weight of the metal alkoxide (B) are contained per 100 parts by weight of the sum of the binder resin and the wax.

2. A developer as set forth in claim 1, wherein the binder resin and the wax are present at a weight ratio of from 99/1 to 1/99.

3. A developer as set forth in claim 1, wherein the copolymer contains in the polymer chain the olefin and the polar group-containing, ethylenically unsaturated monomer at a molar ratio of from 99/1 to 70/30.

4. A developer as set forth in claim 1 or 3, wherein the polar group-containing, ethylenically unsaturated monomer is an ethylenic monomer having at least one member selected from the group consisting of carboxyl, acid anhydride, ester, amide, hydroxyl, epoxy and alkoxy groups.

5. A developer as set forth in claim 1, wherein the copolymer is a copolymer of ethylene with at least one member selected from the group consisting of vinyl esters, vinyl alcohol, ethylenically unsaturated carboxylic acids and anhydrides thereof.

6. A developer as set forth in claim 1, wherein the metal alkoxide is an alkoxide represented by the following formula:

$$M(OR)_mX_{n-m}$$

wherein X stands for an aluminum or titanium atom, R stands for an alkyl group having up to 10 carbon atoms, X stands for a ligand derived from a β-diketone or β-keto acid ester or an acyloxy group, m is a number of from 2 to 4, and n represents the atomic valency of the metal M.

7. A developer as set forth in claim 1 or 2, wherein the binder resin is a copolymer of a vinyl aromatic monomer with an acrylic monomer.

8. A developer as set forth in claim 1 wherein the copolymer (A) has a softening point in the range of from 80° to 180° C. and wherein the molar ratio of the olefin and the polar group-containing ethylenically unsaturated monomer in the polymer chain of the copolymer is from 97/3 to 70/30.

9. A dry developer as set forth in claim 1 wherein the metal alkoxide (B) is selected from the group consisting of titanium tetra-isopropoxide, titanium n-butoxide, tetrakis(2-ethylhexoxy) titanium, aluminum tri-isopropoxide, mono-n-butoxy-di-isopropoxy aluminum, di-isopropoxy-bis-(acetylacetonato)titanium, tri-n-butoxy titanium monostearate and di-isopropoxy aluminum ethylacetoacetate.

10. A developer as set forth in claim 9 wherein the wax has a softening point in the range of from about 65° C. to about 160° C.

11. A pressure-fixing developer according to claim 1 wherein the weight ratio of the binder medium to the wax is in the range of from 85/15 to 1/99.

12. A heat-fixing developer according to claim 1 wherein the weight ratio of the binder medium to the wax is in the range of from 99/1 to 80/20.

* * * * *